US006756538B1

(12) United States Patent
Murga-Gonzalez et al.

(10) Patent No.: US 6,756,538 B1
(45) Date of Patent: Jun. 29, 2004

(54) COAXIAL CABLE HAVING IMPROVED MECHANICAL AND ELECTRICAL PROPERTIES

(75) Inventors: Patricio G. Murga-Gonzalez, Monterrey (MX); Jose Ranc-Gomez, San Pedro Garza Garcia (MX); Sergio Montes-Valdez, Monterrey (MX)

(73) Assignee: Conductores Monterrey S.A. de C.V., San Nicolas de Los Garza (MX)

( * ) Notice: Subject to any disclaimer, the term of this patent is extended or adjusted under 35 U.S.C. 154(b) by 0 days.

(21) Appl. No.: 10/352,461

(22) Filed: Jan. 29, 2003

(51) Int. Cl.[7] ..... H01B 11/00
(52) U.S. Cl. ..... 174/28; 174/36; 174/102 R
(58) Field of Search ..... 174/28, 102 R, 174/110 R, 110 F, 110 FC, 102 D, 36, 110 PM, 120 R, 120 AR; 428/383, 461

(56) References Cited

U.S. PATENT DOCUMENTS

| | | | | |
|---|---|---|---|---|
| 2,970,129 A | | 1/1961 | Rugg et al. | |
| 3,287,489 A | | 11/1966 | Hvizd | |
| 3,520,861 A | | 7/1970 | Thomson et al. | |
| 3,681,515 A | | 8/1972 | Mildner | |
| 3,745,232 A | * | 7/1973 | Johnson et al. | 174/107 |
| 3,795,540 A | | 3/1974 | Mildner | |
| 3,985,948 A | * | 10/1976 | Olszewski et al. | 174/28 |
| 4,104,481 A | * | 8/1978 | Wilkenloh et al. | 174/28 |
| 4,107,354 A | * | 8/1978 | Wilkenloh et al. | 427/118 |
| 4,468,435 A | * | 8/1984 | Shimba et al. | 428/383 |
| 4,683,166 A | * | 7/1987 | Yuto et al. | 428/314.8 |
| 5,500,488 A | * | 3/1996 | Buckel | 174/102 R |
| 6,037,545 A | * | 3/2000 | Fox et al. | 174/110 R |
| 6,201,189 B1 | * | 3/2001 | Carlson et al. | 174/102 R |
| 6,239,377 B1 | * | 5/2001 | Nishikawa | 174/110 R |
| 6,288,328 B1 | * | 9/2001 | Brake et al. | 174/28 |

* cited by examiner

*Primary Examiner*—William H. Mayo, III
(74) *Attorney, Agent, or Firm*—Harrison & Egbert

(57) ABSTRACT

A coaxial cable has a return loss higher than 36 dB and a structural return loss higher than 38 dB within the frequency range from 500 to 1000 MHz. The coaxial cable has a polyolefin inner solid insulating layer having an adhesive strength of between 40 and 60 lb/in$^2$ to a central conductor, an intermediate foamed polyolefin layer surrounding the polyolefin inner solid insulating layer, an outer polyolefin solid insulating layer surrounding the intermediate foamed polyolefin layer, a metallic screen layer that has of a shield made of a metallic foil and a braid surrounding the outer polyolefin solid insulation layer, and a protective jacket surrounding the metallic screen layer.

4 Claims, 1 Drawing Sheet

COAXIAL CABLE HAVING IMPROVED MECHANICAL AND ELECTRICAL PROPERTIES

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to coaxial cables, and more particularly to coaxial cables having improved mechanical and electrical properties.

BACKGROUND OF THE INVENTION

A typical coaxial cable used for data, voice and signal transmission comprises a central conductor surrounded by an insulating foam layer, a screen layer surrounding the insulating foam layer and a protective exterior jacket surrounding the screen layer. Other typical coaxial cable designs include two additional insulation layers of solid material surrounding one of them the central conductor and the other the insulating foam layer.

The insulating structure, which surrounds the central conductor, has several functions such as to separate the central conductor from the screen layer, while keeping the dielectric losses to a minimum. Air is known as one of the best insulators available, and the foam is typically made from a foamed compound having a high content of air bubbles which serves as an excellent insulator, therefore, the more air bubbles the foam layer have the better insulating properties will have thereof.

The dielectric and mechanical characteristics of the coaxial cables are of a great importance in order to assure an optimum data, voice and signal transmission and to avoid losses or distortion of data. It has been observed that when the coaxial cable is severely manipulated, the material of the foam layer tends to compress or to bend due to mechanical stresses, which deforms the foam layer, and consequently causes variations of the dielectric properties, leading to distortion of data, data losses, etc. It should be noted that in drop coaxial cables the adherence between the conductor and the insulation structure is extremely important since poor adherence between these two components may cause installation or connection problems and moisture can penetrate during service into the eke deteriorating its dielectric properties.

Therefore, it would be highly desirable to have a coaxial cable having high adherence between the central conductor and the insulating foam layer to protect it against mechanical stress and moisture penetration. This high adherence can preserve the mechanical and electrical properties of the coaxial cable during severe manipulation. One solution to this problem is to apply adhesives between the conductor and the insulation structure, such as those disclosed in the U.S. Pat, Nos. 2,970,129, 3,520,861, 3,681,515 and 3,795,540. However, such adhesives adversely affect the electrical properties of coaxial cables. Another solution to protect the foam layer against mechanical stress and moisture is by having multilayer insulating structures. Structures disclosed by Nishikawa (U.S. Pat. No. 6,239,377) and Hvizd (U.S. Pat. No. 3,287,489) have a three-insulation layer configuration. However the disclosed functions of the multilayer insulation structures in these patents do not disclose the high adhesion levels required between the foam layer and the central conductor in order to protect the foam layer against mechanical stress without adversely affecting the electrical performance of the coaxial cable.

BRIEF SUMMARY OF THE INVENTION

In view of the above referred problems, intensive experimental work was undertaken to increase the adhesion between the central conductor and the foam insulation layer without adversely affecting the electrical properties of coaxial cables. Surprisingly, it was discovered that blending a polyolefin with an ionic hydrocarbon polymer within a narrow concentration range and applying it between the inner conductor and the foam insulation layer produced adhesion strengths higher than 40 lb/in$^2$ without using any adhesive and without affecting any electrical property of the coaxial cable. However, field experience indicates that adherence values higher than 60 lb/in$^2$ cause installation problems due to the extra effort required stripping the insulation. Another problem is that residues are left on the central conductor, which must be removed in order to have good electrical contact. Furthermore, it was found that the Return Loss and Structural Return Loss were surprisingly improved.

When a coaxial cable is operating, a signal traveling down the line is reflected partially and the reflection travels back to the signal source. These reflections are caused by variations in conductor diameter, diameter, degree of foaming and dielectric constant of the insulation layer, eccentricity, and surface imperfections between layers. Return Loss (RL) is the electrical measurement to quantify the variation in the characteristic impedance along the frequency spectrum. SRL (structural return loss) describes the portion of the return loss, which is due to structural changes along the cable.

It is accordingly a major object of the present invention to provide a coaxial cable having an insulating multilayer structure having improved tolerance to severe manipulation during its installation, connection and useful service life. It is still a main objective of the present invention to provide a coaxial cable with improved data, voice and signal transmission characteristics resulting from enhanced Return Loss and Structural Return Loss properties.

It is another object of the present invention to provide a coaxial cable having a solid polyolefin inner layer with an adherence between 40 and 60 lb/in$^2$ between the central conductor and the inner solid insulating layer; an intermediate foamed polyolefin layer surrounding the inner layer; an outer solid polyolefin layer surrounding the intermediate foamed layer; a metallic screen layer surrounding the outer polyolefin layer and a protective exterior jacket surrounding the screen layer.

Another object of the present invention is to provide a coaxial cable wherein the solid polyolefin inner insulation layer comprises a blend of low-density polyethylene with 8 to 15 weight percent of an ionic hydrocarbon polymer. The ionic hydrocarbon polymer of the present invention contains monocarboxylic acid comonomers, wherein the carboxylic acid units of the copolymers are partially neutralized with metal ions. Such materials are sold by E. I. du Pont de Nemours and Company under the trade name SURLYN™ as disclosed in the U.S. Pat. No. 3,264,272.

Another object of the present invention is to provide a coaxial cable with a minimum of 36 dB of Return Loss and 39 dB of Structural Return Loss in the frequency range from 500 to 1000 MHz as a result of using an inner solid insulating layer consisting of a blend of 8 to 15 weight percent of an ionic hydrocarbon polymer

DETAILED DESCRIPTION OF THE INVENTION

Figure 1:
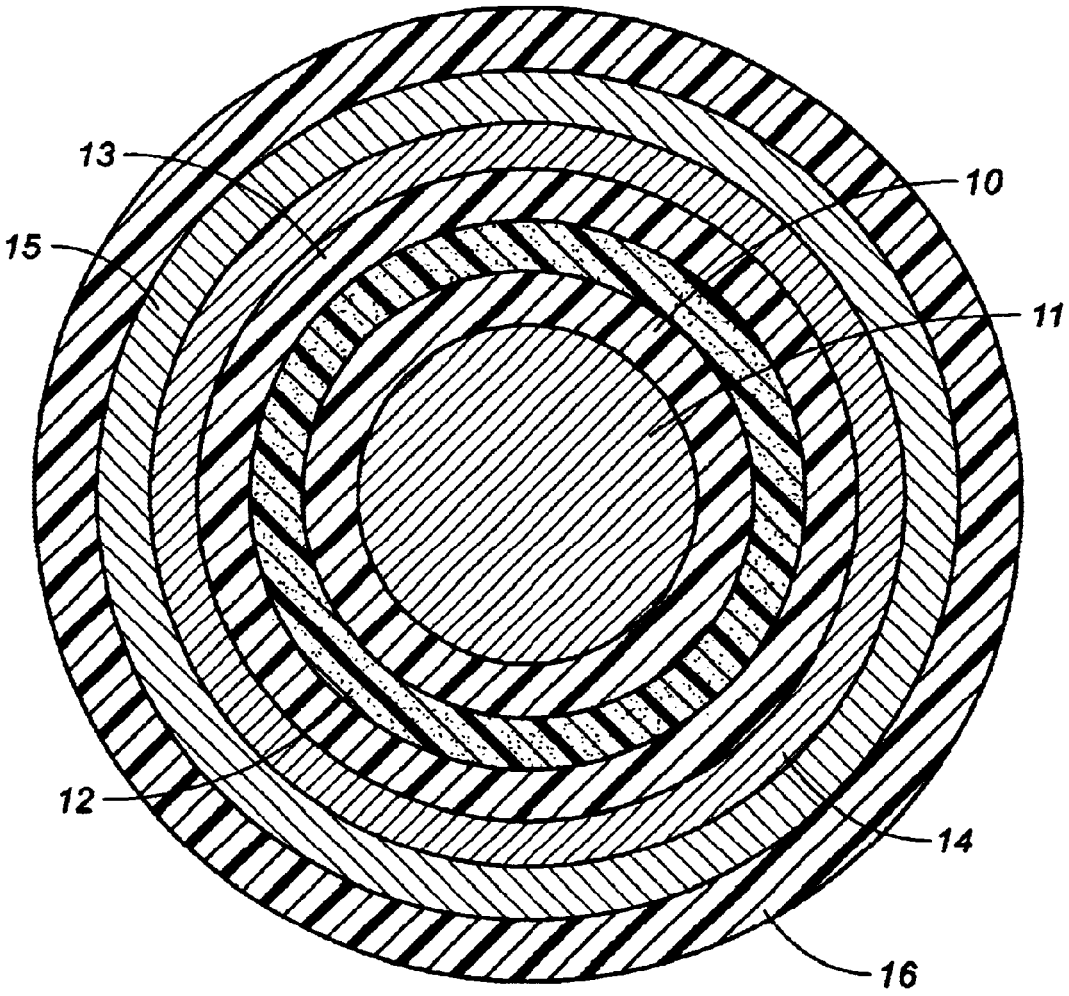
FIG. 1 is a cross-sectional view of a coaxial cable according to the present invention.

FIG. 1 illustrates schematically the structure of one coaxial cable made according to the present invention. The coaxial cable 1 comprises a solid polyolefin inner insulation layer 10 having an adherence between 40 and 60 lb/in$^2$ to the central conductor 11. A foamed polyolefin layer 12 surrounds the inner solid insulation layer 10. An outer solid polyolefin insulating layer 13, surrounds the foamed layer 12. The coaxial cable according to the present invention also includes a metallic screen layer consisting of a shield made of a metallic foil 14 surrounding the outer solid insulation layer 13 and a braid 15, surrounding the metallic foil 14. A protective outer jacket 16 surrounds the braid 15.

The high adherence between the central conductor 11 and the solid polyolefin inner insulating layer 10 provides a coaxial cable with an improved resistance to mechanical stress. Improved data, voice and signal transmission characteristics are also obtained due to these high adherence values.

In a preferred embodiment, the inner solid polyolefin insulating layer 10 comprises a blend of a low density polyethylene with 8 to 15 weight percent of an ionic hydrocarbon polymer. The ionic hydrocarbon polymer of the present invention contains monocarboxylic acid comonomers, wherein the carboxylic acid units of the copolymers are partially neutralized with metal ions. Such materials are sold by E. I. du Pont de Nemours and Company under the trade name SURLYN™ as disclosed in the U.S. Pat. No. 3,264,272. As the SURLYN™ compound improves the adhesion between the central conductor and the polyolefin solid insulation layer, the contact surface will be continuously smooth and consistent, reducing air gaps. It makes less surface imperfections, one of the main causes of reflections in the cable.

In the preferred embodiment the central conductor is copper. In other preferred embodiments the central conductor is copper clad steel.

The high adherence high values obtained between different conductors and a solid insulation layer according to the present invention can be seen by examining the test results described in the following examples. The center conductor bonded to the solid inner insulating layer was measured according to the SCTE IPS-SP-01 Standard. The adherence (lb/in$^2$) was calculated dividing the measured bond force (lb) by the contact area (in$^2$) between the conductor and the dielectric.

EXAMPLE 1

The adherence results between a central conductor and a solid insulation layer according to the present invention wherein the central conductor is copper, are shown in Table 1. This table shows an increase in adherence from 27 to 45.4 lb/in$^2$ due to the use of an inner solid insulating layer consisting of a blend of low density polyethylene with 8 weight percent of an ionic hydrocarbon polymer.

TABLE 1

| Composition of the inner solid insulating layer | Adherence (lb/in$^2$) | Standard deviation σ | Number of samples |
|---|---|---|---|
| Low density polyethylene | 27.0 | ±2.6 | 358 |
| Blend of low density polyethylene with 8 weight percent of an ionic hydrocarbon polymer according to the present invention. | 45.4 | ±2.4 | 259 |

EXAMPLE 2

The adherence results between a central conductor and a solid insulation layer according to the present invention wherein the central conductor is copper clad steel are shown in Table 2. This table shows an increase in adherence from 22 to 44.1 lb/in$^2$ due to the use of an inner solid insulating layer consisting of a blend of low density polyethylene with 8 weight percent of an ionic hydrocarbon polymer.

TABLE 2

| Composition of the inner solid insulating layer | Adherence (lb/in$^2$) | Standard deviation Σ | Number of samples |
|---|---|---|---|
| Low density polyethylene | 22.7 | ±2.6 | 169 |
| Blend of low density polyethylene with 8 weight percent of an ionic hydrocarbon polymer according to the present invention. | 44.1 | ±2.4 | 144 |

Further field experience indicates that adherence values higher than 60 lb/in$^2$ cause installation problems due to the extra effort required to strip the insulation. Another problem is that residues are left on the central conductor, which must be removed in order to have good electrical contact.

When a coaxial cable is operating, a signal traveling down the line is reflected partially and the reflection travels back to the signal source. These reflections are caused by variations in conductor diameter, diameter, degree of foaming and dielectric constant of the insulation layer, eccentricity, and surface imperfections between layers. Return Loss (RL) is the electrical measurement to quantify the variation in the characteristic impedance along the frequency spectrum. SRL (structural return loss) describes the portion of the return loss that is due to structural changes along the cable.

The advantages of the present invention are further illustrated with the following electrical tests. In a first set of samples, coaxial cables were made using a low density polyethylene as the inner solid insulating layer material surrounding a copper conductor. A second set of samples was made using a blend of low density polyethylene with 8 weight percent of an ionic hydrocarbon polymer according to the present invention. Return Loss (RL) and Structural Return Loss (SRQ were measured following the procedures outlined in the following standard:

ANSI/SCTE-IPS-TP-007 *"American National Standard for Test Method for Coaxial Cable Structural Return Loss"*

The results of Return Loss as a function of testing frequency are shown in Table 3.

TABLE 3

| Composition of the inner solid insulating layer | Return Loss (dB) at various test frequencies (MHz)(a) | | | | | |
|---|---|---|---|---|---|---|
| | 500 MHz | 600 MHz | 700 MHz | 800 MHz | 900 MHz | 1000 MHz |
| Low density polyethylene | 36.98 | 36.61 | 36.25 | 35.88 | 35.52 | 35.15 |
| Blend of low density polyethylene with 8 weight percent of an ionic hydrocarbon polymer according to the present invention. | 38.03 | 37.68 | 37.34 | 36.99 | 36.65 | 36.30 |

(a)average results from 10 runs

As it can be seen from table 3, if an inner solid insulating layer, made according to the present invention, surrounds a copper conductor, the return loss values of the resultant coaxial cable, at the shown test frequencies, are higher than those resulting from a coaxial cable having an inner solid insulating layer made from low density polyethylene. These results mean that the coaxial cable of the present invention has better data, voice and signal transmission characteristics than the cable made with an inner insulating layer consisting of a low density polyethylene alone.

The results of Structural Return Loss are shown in Table 4.

TABLE 4

| Composition of inner insulating layer | Structural Return Loss (dB) at various test frequencies (MHz)(a) | | | | |
|---|---|---|---|---|---|
| | 600 MHz | 700 MHz | 800 MHz | 900 MHz | 1000 MHz |
| Low density polyethylene | 40.34 | 39.35 | 38.37 | 37.38 | 36.40 |
| Blend of low density polyethylene with 8 weight percent of an ionic hydrocarbon polymer according to the present invention. | 41.34 | 40.73 | 40.12 | 39.51 | 38.90 |

(a)average results from 10 runs.

As it can be seen from table 4, if an inner solid insulating layer, made according to the present invention, surrounds a copper conductor, the SRL values of the resultant coaxial cable, at the shown test frequencies, are higher than those resulting from a coaxial cable having an inner solid insulating layer made from low density polyethylene. These results mean that the coaxial cable of the present invention has better data, voice and signal transmission characteristics than the cable made with an inner insulating layer consisting of a low density polyethylene alone.

We claim:

1. A coaxial cable having a return loss higher than 36 dB and a structural return loss higher than 38 dB within the frequency range from 500 to 1000 MHz, the coaxial cable comprising:

a central conductor;

an inner polyolefin solid insulating layer surrounding said central conductor and being adhered to said central conductor in an amount of between 40 and 60 $lb/in^2$;

an intermediate foamed polyolefin insulating layer surrounding a surface of said inner polyolefin solid insulating layer opposite said central conductor;

an outer polyolefin solid insulating layer surrounding a surface of said intermediate foamed polyolefin insulating layer opposite said inner polyolefin solid insulating layer;

a metallic screen layer being a shield of a metallic foil and a braid, said metallic screen layer surrounding a surface of said polyolefin solid insulating layer opposite said intermediate foamed polyolefin insulating layer; and a protective jacket surrounding a surface of said metallic screen layer opposite said outer polyolefin solid insulating layer.

2. The coaxial cable of claim 1, said inner polyolefin solid insulating layer comprising a blend of a low density polyolefin having a 8 to 15 weight percent of an ionic hydrocarbon polymer containing monocarboxylic acid comonomers, said monocarboxylic acid units being partially neutralized with metal ions.

3. The coaxial cable of claim 1, said central conductor being a copper material.

4. The coaxial cable of claim 1, said central conductor being copper clad steel.

* * * * *